United States Patent [19]

Sitzmann et al.

[11] 4,317,928

[45] Mar. 2, 1982

[54] N,N,N',N'-TETRAKIS(2-FLUORO-2,2-DINITROETHYL) OXAMIDE AND A METHOD OF PREPARATION THEREOF

[75] Inventors: Michael E. Sitzmann, Adelphi; William H. Gilligan, Ft. Washington, both of Md.

[73] Assignee: The United States of America as represented by the Secretary of the Navy, Washington, D.C.

[21] Appl. No.: 228,032

[22] Filed: Jan. 23, 1981

[51] Int. Cl.[3] ..... C07C 103/14; C07C 133/02

[52] U.S. Cl. ..... 564/160; 260/141; 260/544 C; 564/35

[58] Field of Search ..... 564/160

[56] References Cited

U.S. PATENT DOCUMENTS

| | | | |
|---|---|---|---|
| 3,644,519 | 6/1979 | Adolph et al. | 564/160 |
| 3,850,978 | 4/1980 | Gilligan et al. | 564/160 |
| 3,873,617 | 7/1980 | Adolph et al. | 564/160 |

*Primary Examiner*—John Doll
*Attorney, Agent, or Firm*—R. S. Sciascia; A. L. Branning; R. D. Johnson

[57] ABSTRACT

N,N,N', N'-tetrakis(2-fluoro-2,2-dinitroethyl) oxamide, which is prepared by the following reaction sequence

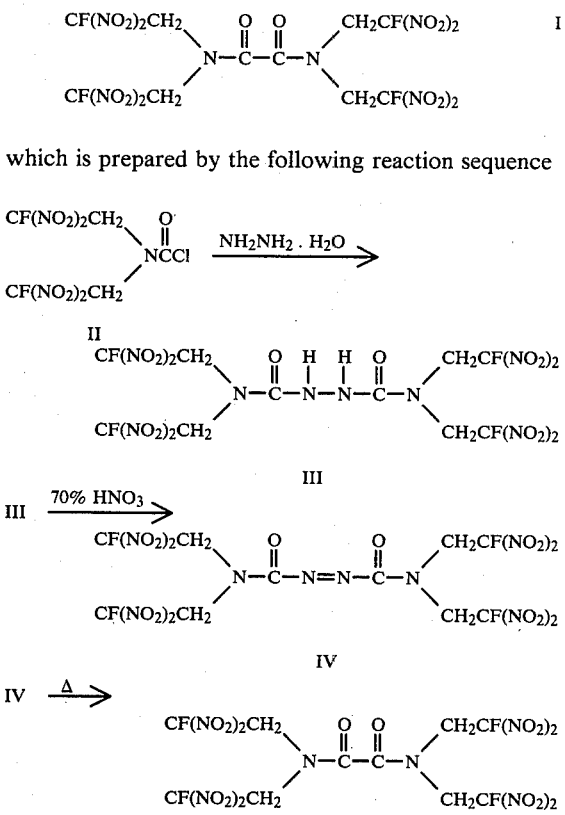

N,N,N',N'-tetrakis(2-fluoro-2,2-dinitroethyl) oxamide is a high density, energetic explosive which is melt castable as well as thermally and hydrolytically stable.

1 Claim, No Drawings

N,N,N',N'-TETRAKIS(2-FLUORO-2,2-DINITROETHYL) OXAMIDE AND A METHOD OF PREPARATION THEREOF

BACKGROUND OF THE INVENTION

This invention relates to explosive compounds and more particularly to explosive nitroorganic compounds.

High density explosives are of primary interest because the detonation pressure (a measure of explosive performance) increases with the square of the density of the explosive. Thus a relatively small increase in explosive density can effect a relatively large increase in explosive power. Despite the huge number of explosives that are known, relatively few are high density explosives (density greater than 1.90 g/ml). Extremely few of these high density explosives are melt castable in addition to being thermally and hydrolytically stable. The two most commonly used dense explosives, HMX and 1,3,5-triamino-2,4,6-trinitrobenzene (TATB), are not melt castable. 1,3,5-trifluoro-2,4,6-trinitrobenzene, a dense melt castable explosive, (mp 80–81) is not chemically stable to water.

Therefore, it would be desirable to provide a high density, energetic, melt castable explosive which is thermally and hydrolytically stable.

SUMMARY OF THE INVENTION

Accordingly, an object of this invention is to provide a novel explosive organic compound.

Another object of this invention is to provide a new high density, energetic explosive.

A further object of this invention is to provide a high density, energetic explosive which is thermally stable.

Yet another object of this invention is to provide a high density, energetic explosive which is hydrolytically stable.

A still further object of this invention is to provide a high density, energetic explosive which is steam-melt castable.

These and other objects of this invention are accomplished by providing N,N,N',N'-tetrakis(2-fluoro-2,2-dinitroethyl) oxamide,

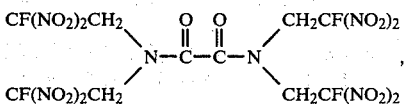

I which is prepared by the following reaction sequence

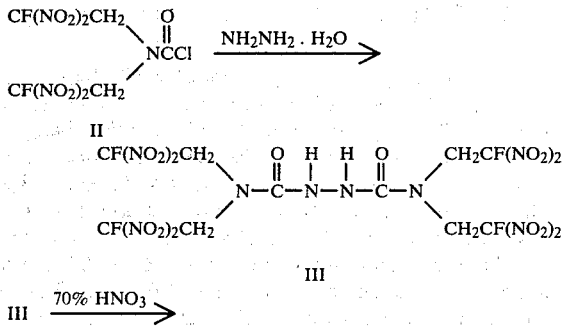

-continued

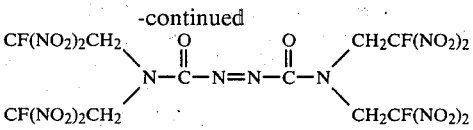

IV

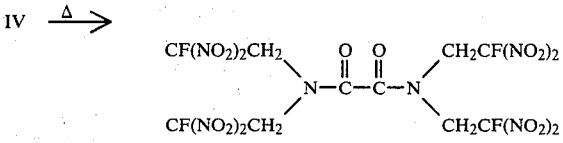

I

N,N,N',N'-tetrakis(2-fluoro-2,2-dinitroethyl) oxamide is a high density, energetic explosive which is melt castable as well as thermally and hydrolytically stable.

DETAILED DESCRIPTION OF THE PREFERRED EMBODIMENT

The preparation of N,N,N',N'-tetrakis(2-fluoro-2,2-dinitroethyl) oxamide has not previously been described in the literature. The easiest and most obvious method for preparation of N,N,N',N'-tetrakis(2-fluoro-2,2-dinitroethyl) oxamide would appear to be the standard reaction of an amine with oxalyl chloride, that is, in this case bis(2-fluoro-2,2-dinitroethyl) amine with oxalyl chloride. However, the reaction fails in this case because the fluorodinitroethyl groups greatly reduce the basicity of the amine nitrogen in bis fluorodinitroethyl amine. Our method for preparation of N,N,N',N'-tetrakis(2-fluoro-2,2-dinitroethyl) oxamide is as follows: N,N-bis(2-fluoro-2,2-dinitroethyl) carbamyl chloride (II) is treated with hydrazine hydrate to give 1,2-di[N,N-bis (2-fluoro-2,2-dinitroethyl) carbamyl] hydrazine (III); oxidation of III with 70% nitric acid yields di[N,N-bis(2-fluoro-2,2-dinitroethyl) carbamyl] diimide (IV) which upon heating is converted to I. The reaction sequence can be represented as follows:

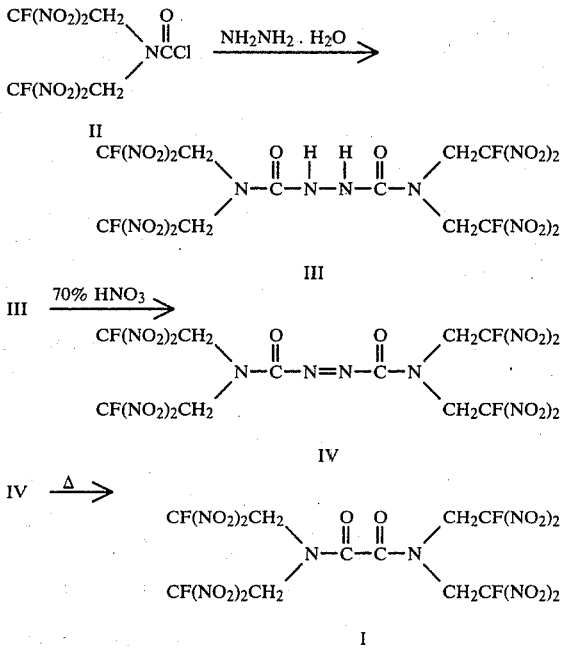

The N,N-bis(2-fluoro-2,2-dinitroethyl)carbamyl chloride starting material was first prepared according to the method disclosed in U.S. Pat. No. 3,850,978 which was issued to W. H. Gilligan and M. J. Kamlet on Nov. 26, 1974, hereby incorporated by reference.

A preferred method of preparing this starting material is disclosed in U.S. Pat. Application Ser. No. 210,981 (Navy Case No. 64,674), entitled, "Method of Preparing N,N-Bis(2-fluoro-2,2-dinitroethyl) carbamyl chloride and its Derivatives," filed by William H. Gilligan and Michael E. Sitzmann on Nov. 28, 1981. The method of preparation is incorporated as examples 1 and 2 of the present application.

The advantage of our invention is that it provides a steam castable high density explosive. A steam castable explosive is preferred because melt casting is the more desirable method of loading explosives into shells or bombs (as opposed to press loading which must be used for non-melt castable explosives). Dense explosives are desirable because high density explosives will provide greater explosive power than a similar explosive of lower density. Thus steam castability and high density are very desirable properties for an explosive and the number of explosives having both these properties are extremely limited.

The general nature of the invention having been set forth, the following examples are presented as specific illustrations thereof. It will be understood that the invention is not limited to these examples but is susceptible to various modifications that will be recognized by one of ordinary skill in the art.

EXPERIMENT

Examples 1 and 2 have been incorporated to illustrate the preparation of the starting material N,N-bis(2-fluoro-2,2-dinitroethyl)carbamyl chloride.

EXAMPLE 1

Preparation of S-ethyl N,N-bis(2-fluoro-2,2-dinitroethyl)thiolcarbamate.

A mixture of 55.0 g (0.19 mol) of bis(2-fluoro-2,2-dinitroethyl) amine, 38 ml of chloroform, 40 ml of ethyl chlorothiolformate and 20 ml of titanium tetrachloride was heated in an oil bath at 65°–67° C. for 17 hours (The reaction mixture was protected from atmospheric moisture with a drierite drying tube). Chloroform (100 ml) was added to the warm mixture which was then filtered through celite. The dark colored filtrate was pulled on a rotary evaporator to give a residue which was dissolved in methanol and treated with charcoal. After filtration, the solvent was removed with a rotary evaporator and the product was crystallized by dissolving in chloroform (55 ml) and cooling in the freezer. The yield was 48.0 g (67%), mp 74°–75° C., NMR (chloroform): δ1.26(t), 2.95 (q), 4.83 (d).

Anal Calcd for $C_7H_9F_2N_5O_9S$: C, 22.29; H, 2.41; N, 18.57; F, 10.07; S, 8.50. Found: C, 22.19; H, 2.37; N, 18.23; F, 9.79, S, 8.32.

EXAMPLE 2

Preparation of N,N-bis(2-fluoro-2,2-dinitroethyl) carbamyl chloride.

A mixture of 30.4 g of S-ethyl N,N-bis(2-fluoro-2,2-dinitroethyl) thiolcarbamate, 125 ml of 1,2-dichloroethane and 60 ml of sulfuryl chloride was cautiously heated to the reflux point. After the initial vigorous gas evolution subsided the reaction mixture was maintained at reflux temperature for 8 hours. The volatiles were removed with a rotary evaporator to give an oily residue which was stirred with 2×340 ml of dry hexane. The hexane extracts were decanted from the insoluble oil which was then pulled dry and dissolved in 25 ml of warm chloroform. Cooling in the freezer gave 24.2 g (85%) of crystals, mp 45°–47° C. NMR (chloroform): δ4.97 (d). IR (KBr): 1745 (c=o), 1604 ($NO_2$) $cm^{-1}$.

Anal. Calcd $C_5H_4Cl\ F_2N_5O_9$: C, 17.08; H, 1.15; Cl, 10.08; F, 10.81; N, 19.92. Found: C, 17.01; H, 1.15; Cl, 10.17; F, 10.89; N, 19.90.

EXAMPLE 3

Preparation of 1,2-di[N,N-bis(2-fluoro-2,2-dinitroethyl)carbamyl]hydrazine (III)

A solution of 8.0 g of N,N-bis(2-fluoro-2,2-dinitroethyl)carbamyl chloride in 40 ml of ethyl ether was rapidly stirred in a water bath at 25° while 2.7 g of hydrazine hydrate (85% solution) was added dropwise over a 35 minute period. Cold water (50 ml) was added, the ether layer was separated, dried with magnesium sulfate, and concentrated to 25 ml by distillation. Chloroform was slowly added until the distillate temperature reached 60° and a large amount of solid had precipitated. After cooling to room temperature, 4.85 g of solid, mp 180–185 dec., was obtained.* Digestion of the solid with boiling methylene chloride gave 4.23 g (56%) of insoluble white solid, mp 195–197 dec. NMR (acetone): δ8.70 (s,NH) 5.18 (d, $CH_2$); IR (KBr): 3330 (NH), 1650 (c=o).

*1.47 g (19%) of N,N-bis(2fluoro-2,2-dinitroethyl) carbamyl hydrazine, mp 102–104 dec., was recovered from the mother liquor.

Anal. calculated for $C_{10}H_{10}F_4N_{12}O_{18}$: C, 18.14; H, 1.52; N, 25.38; F, 11.48; mol. wt. 662.27. Found: C, 18.39; H, 1.40; N, 25.16; F, 11.38; mol. wt. 661.

EXAMPLE 4

Preparation of Di[N,N-bis(2-fluoro-2,2-dinitroethyl)carbamyl]diimide (IV)

Nitric acid (70%) (60 ml) was stirred at 20° C. in a water bath while 4.66 g of 1,2-di[N,N-bis(2-fluoro-2,2-dinitroethyl)carbamyl] hydrazine was added in portions over a 7 minute period. The mixture was stirred rapidly for 5 hours before 80 ml of cold water was added. Filtration gave 4.46 g (96%) of light orange crystals, mp 158–160 dec. Crystallization from tetrahydrofuran—1,2-dichloroethane did not raise the melting point. NMR (acetone): δ5.54 (multiplet); IR (KBr): 1745 (c=o).

Anal. calculated for $C_{10}H_8N_{12}F_4O_{18}$: C, 18.19; H, 1.22; N, 25.46; F, 11.51. Found: C, 18.32; H, 1.21; N, 25.20; F, 11.53.

EXAMPLE 5

Preparation of N,N,N',N'-Tetrakis(2-fluoro-2,2-dinitroethyl)oxamide (I)

Five samples (0.3 g each) of di[N,N-bis(2-fluoro-2,2-dinitiroethyl) carbamyl] diimide were heated in an oil bath at 150°–160° until the color of the melts changed from red to light orange (after about 20 min.). The products were combined and stirred with 15 ml of ethyl ether. Unreacted diimide remained insoluble and was removed before the ether soluble product was purified by column chromatography (silica gel 60, 70–230 mesh, using first benzene as eluent, then 50–50 methylene chloride-hexane with a gradual increase to 100% methylene chloride). A total of 0.51 g (36%) of white solid mp 90–93, was obtained. Crystallization from chloroform raised the melting point to 92°–94°. On TLC (silica gel) the oxamide (I) moves only slightly off the origin ($R_F \sim 0.05$) with toluene as developer but has $R_F = 0.27$ with methylene chloride. Visualization is accomplished by spraying with 25% KOH—methanol, then with 50% $H_2SO_4$ containing a small amount of diphenylamine. NMR (acetone): δ5.37 (d), 5.27 (d); IR (KBr): 1690 with shoulder at 1700 (c=o); mass spectrum (C.I.); (m/e) 633 (M+1).

Anal. calculated for $C_{10}H_8N_{10}F_4O_{18}$: C, 19.00; H, 1.28; N, 22.15; F, 12.02. Found: C, 19.05; H, 1.32; N, 21.99; F, 11.85.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. N,N,N′,N′-tetrakis(2-fluoro-2,2-dinitroethyl)oxamide.

* * * * *